United States Patent [19]

Machanian et al.

[11] 3,935,783

[45] Feb. 3, 1976

[54] ELECTRONIC PIANO CIRCUIT

[75] Inventors: William V. Machanian, Lewiston, N.Y.; Robert R. Williams, St. Joseph, Mich.

[73] Assignee: The Wurlitzer Company, Chicago, Ill.

[22] Filed: July 8, 1974

[21] Appl. No.: 486,503

[52] U.S. Cl. ..... 84/1.21; 84/1.1; 84/1.12; 84/1.13; 84/1.23; 84/1.26

[51] Int. Cl.² ..... G10H 1/06; G10H 5/10

[58] Field of Search ..... 84/1.01, 1.11–1.13, 84/1.19–1.23, 1.26, DIG. 23

[56] References Cited

UNITED STATES PATENTS

| | | | |
|---|---|---|---|
| 2,142,580 | 1/1939 | Williams | 84/1.23 X |
| 3,505,461 | 4/1970 | Omura et al. | 84/1.01 |
| 3,515,039 | 6/1970 | Omura et al. | 84/1.01 |
| 3,534,144 | 10/1970 | Ring | 84/1.01 |
| 3,636,231 | 1/1972 | Schrecongost | 84/1.23 |
| 3,809,786 | 5/1974 | Deutsch | 84/1.01 |
| 3,809,789 | 5/1974 | Deutsch | 84/1.01 |
| 3,821,714 | 6/1974 | Tomisawa et al. | 84/1.01 X |

*Primary Examiner*—L. T. Hix
*Assistant Examiner*—Stanley J. Witkowski
*Attorney, Agent, or Firm*—Olson, Trexler, Wolters, Bushnell & Fosse, Ltd.

[57] ABSTRACT

The embodiment of the invention disclosed herein is directed to an electronic musical instrument of the keyboard type used to electronically reproduce piano sounds. The circuit has means to vary the amplitude of the piano voice in response to the velocity of the downward movement of the key. Means are provided for producing a fundamental square wave frequency and the second and fourth harmonics thereof, in response to the actuation of a given key on the keyboard. One circuit arrangement includes means for combining the fundamental frequency and the second and fourth harmonics in a predetermined time relation to produce the zero, attack, peak, and decay characteristics of a piano voice as actually produced by a piano string. Amplitude limiting means are coupled to the circuit for controlling the amplitude of the harmonics in response to predetermined values so that mixing of the fundamental frequency and the second and fourth harmonics along predetermined points of the piano voice characteristics curve will more accurately reproduce electronically the sounds of a piano. Another circuit arrangement provides means for rapid recovery of the piano circuit so that the keys can be actuated in rapid succession.

18 Claims, 11 Drawing Figures

10
60
64
66
AMPLIFIER
61
62
63
RF SQUARE WAVE GENERATOR
50
51
MFG
53
56
54
DIVIDERS
82
41
40
39
52
STROBE
11
B+
24
KEY
30
23
22
21
28
29
32
ON
31
OFF
33
26
27
34
12
17
36
46
37
44
42
43

75
75'
A
T
78
78
½A
½T
81
81
¼A
¼T
71
71
6/4A
6/4T
72
72
7/4A
7/4T

ELECTRONIC PIANO CIRCUIT

BACKGROUND OF THE INVENTION

This invention relates generally to electronic musical instruments and more particularly to electronic pianos. Specifically, the invention is directed to circuit means for varying the amplitude of the piano characteristic curve envelope in response to the relative hardness with which the piano key is actuated, and for mixing together a fundamental frequency and selected components of harmonics thereof to produce musical tones that correspond substantially to a piano voice.

Heretofore, the manufacturer of electronic musical instruments, particularly those of the electronic piano type, have gone to great lengths to produce a keyboard arrangement which is substantially electronic in nature, free of hammers and strings, but which will electronically reproduce the tones of an actual piano string when struck. Among the problems in so providing electronic piano keyboards is that of producing the proper attack, peak, and decay characteristic curve of a piano voice. This has been closely approximated in the past by providing capacitor charge circuits which operate in response to capacitor discharge circuits so that charge rates and discharge rates of capacitors will produce attack and decay characteristics along an exponential curve. However, this type of electronic piano keyboard is at best an approximation of a real piano string tone.

One of the problems of electronic pianos is that while a close approximation of the actual attack, peak, and decay characteristics of the piano voice is obtained by capacitor discharge and charge circuits, these circuits do not compensate for variations in harmonic tones of the fundamental frequency of the piano string along the piano voice characteristic curve. Therefore, their actual sound is a false representation of a real piano.

SUMMARY OF THE INVENTION

Accordingly, it is an object of this invention to provide a new and improved electronic piano circuit which provides means for varying the harmonic content of the piano voice as a function of time and amplitude along the piano voice characteristic curve.

Another object of this invention is to provide a new and improved electronic circuit for a piano keyboard that will produce an amplitude of the peak portion of the piano characteristic curve which corresponds to the rate of travel or relative hardness with which the key is actuated.

Still another object of this invention is to provide a new and improved electronic circuit for use in a piano keyboard instrument which will allow rapid actuation of the keys.

Briefly, the electronic circuits of this invention are specifically designed for use with piano keyboard circuits and include circuits for producing gate signals in response to the actuation of associated keys on the keyboard. The gate signals have a wave shape which corresponds to the zero, attack, peak, and decay characteristics of piano voice curves. Throughout the specification and claims, the term piano voice is intended to indicate the type of envelope characteristic which contains the fundamental and harmonic frequencies of the particular string or note of a piano sound as well as the frequencies and harmonics associated therewith. Before a piano key is struck the piano voice is at a zero condition. Upon initial striking of a piano key the piano voice abruptly rises along an attack characteristic curve sharply culminating at a peak and then reversing along a decay curve which has a more gradual rate of descent than the rate of ascent on the attack side. The attack and decay characteristics are exponential, but of substantially different rates. This type of piano voice characteristic is essential in reproducing electronically those tone qualities which are produced by mechanical piano hammer and string mechanisms.

Audio-signal generator means are provided for producing fundamental square wave frequencies for the particular keys being struck as well as several of the harmonics associated with the particular fundamental square wave frequency. In the illustrated embodiment the second and fourth harmonics, also square waves, are generated and mixed with the fundamental frequency only at predetermined points in time along the voice characteristic curve. By so selectively mixing the harmonics with the fundamental frequency a more true piano voice characteristic is obtained by the electronic piano circuit.

To selectively mix the harmonics with the fundamental frequency gate circuit means are coupled between the audio-signal generator means and an audio amplifier. This gate circuit is responsive to the gate signal and has selected portions thereof energized only at predetermined minimum levels of the gate signal so that mixing of the harmonic occurs only at these levels and therefore, only at selected points in time along the characteristic curve.

In one circuit configuration of the illustrated embodiments, the piano key circuit is capable of being rapidly extinguished immediately after the piano key is released so that the piano key can be actuated in rapid succession. Furthermore, the circuit incorporates a novel transistor biasing configuration to enable a transistor to function as a zener diode in the circuit so that the decay characteristic curve of the piano voice changes depending on the amplitude of the curve.

Many objects, features, and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENT

Figure 1:
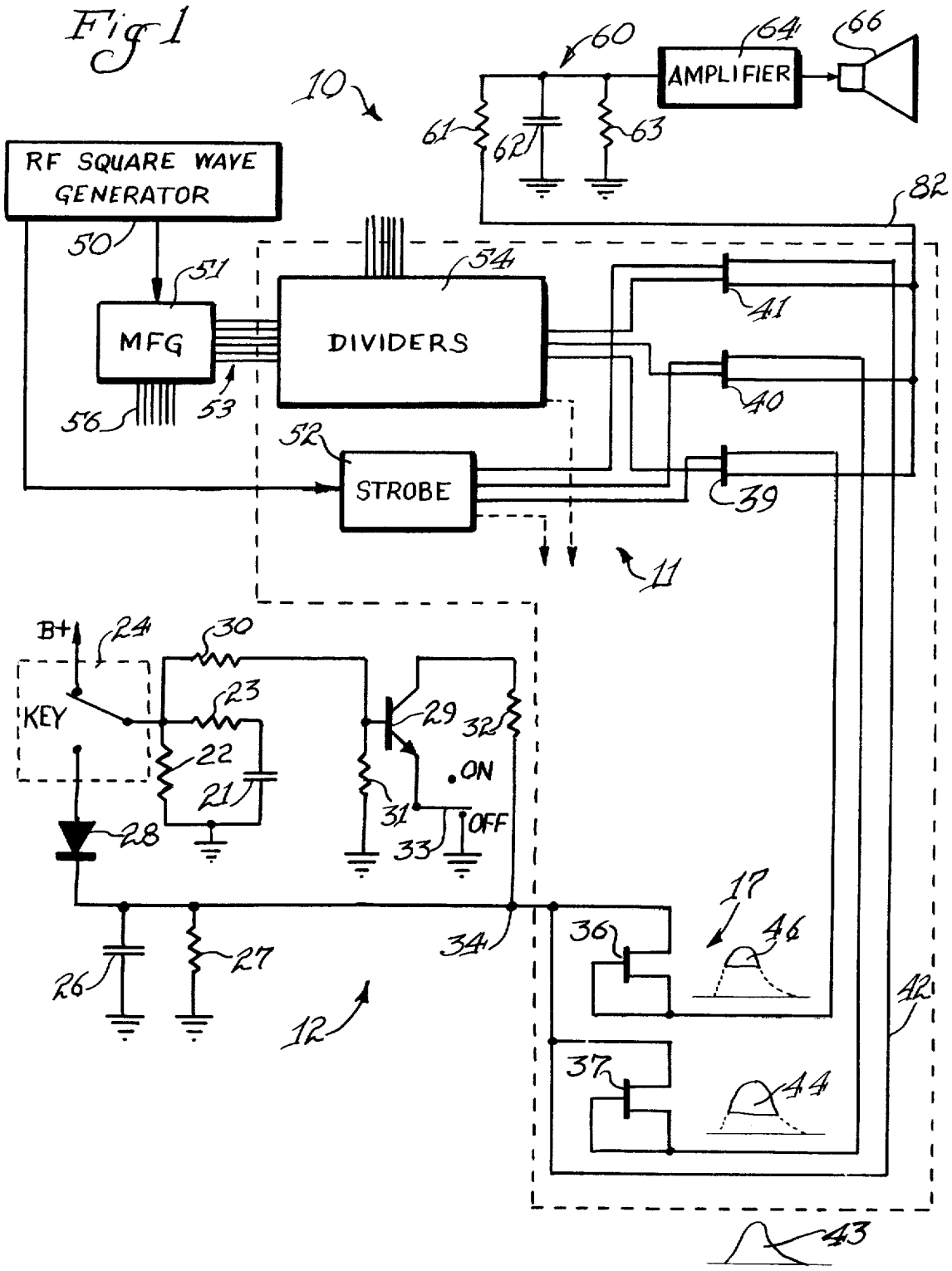
FIG. 1 is a schematic block diagram of an electronic piano constructed in accordance with the principles of this invention.
Figure 6:
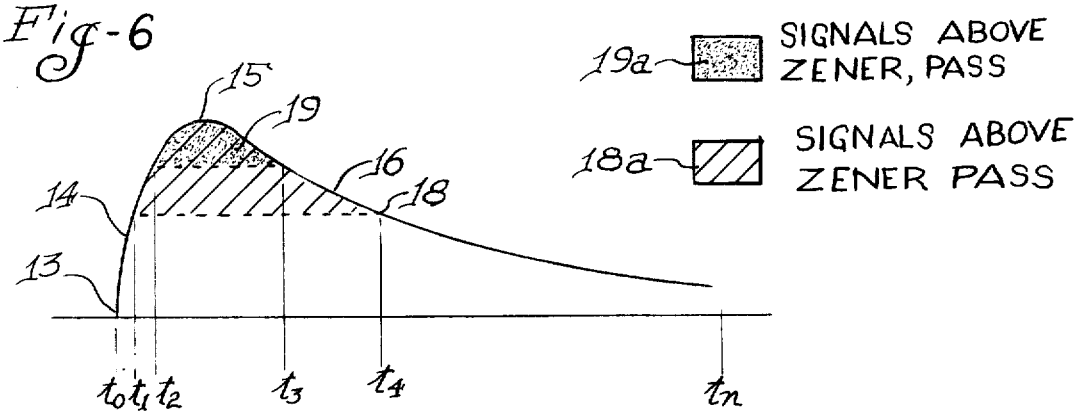
FIG. 6 illustrates a piano voice characteristic envelope curve having zero, attack, peak, and decay characteristics which change in amplitude with respect to time.

Referring now to FIG. 1 there is seen an electronic musical instrument of the keyboard type constructed in accordance with the principles of this invention and designated generally by reference numeral 10. The electronic musical instrument 10 includes electronic means 11 for audibly producing a fundamental frequency and a plurality of harmonic frequencies when a key on the keyboard is actuated. The electronic means 11 is coupled to circuit means 12 for providing a key velocity sensitive envelope curve to control the amplitude of the fundamental frequency in response to the relative velocity of actuation of the piano key thereby substantially simulating the characteristic of a piano voice. For example, FIG. 6 illustrates a characteristic curve showing the zero 13, attack 14, peak 15, and decay 16 components of a piano voice characteristic envelope curve. Amplitude limiting means 17, FIG. 1, is connected to the gate circuit portions of the electronic circuit 11 and controls the amount of mixing of the harmonic signals with that of the fundamental frequency. By controlling the amplitude of the harmonic signals mixed with the fundamental frequency signals along the characteristic envelope curve a more accurate sounding piano voice can be generated by the electronic means.

The mixing of the harmonic signal with the fundamental frequencies occurs only at an amplitude equal to or greater than a predetermined minimum amplitude as shown on the curve of FIG. 6. For example, at time $t_o$ no voicing of a piano signal occurs. However, between $t_o$ and $t_1$ the attack characteristic curve 14 advances sharply to a level 18 along which only the fundamental square wave frequency occurs during this time interval. Between $t_1$ and $t_2$ the first one of the harmonic signals, which may be the second harmonic square wave of the fundamental frequency, is mixed with the fundamental frequency and changes the piano voicing characteristic of the sound being produced. At $t_2$, and until $t_3$ the second one of the harmonic signals, which may be the fourth harmonic square wave of the fundamental frequency, is allowed to be mixed with the fundamental frequency and is indicated by the amplitude line 19. The legends **18*a* and 19*a* indicate the minimum amplitudes which must exceed a threshold voltage or zener voltage before mixing of the second and fourth harmonic signals occurs with the fundamental frequency. Along the decay characteristic curve 16 immediately following the peak portion 15 all of the harmonics are mixed together with the fundamental frequency until $t_3$. At $t_3$ the fourth harmonic signal is blocked by the Zener effect of the limiting means 17** and therefore only the fundamental frequency and the second harmonic signal is mixed along the curve until time $t_4$. At time $t_4$ the amplitude of the harmonics is substantially decreased so that only the fundamental square wave frequency is applied to the amplifier output circuit of the electronic piano until time $t_n$.

Figure 7:
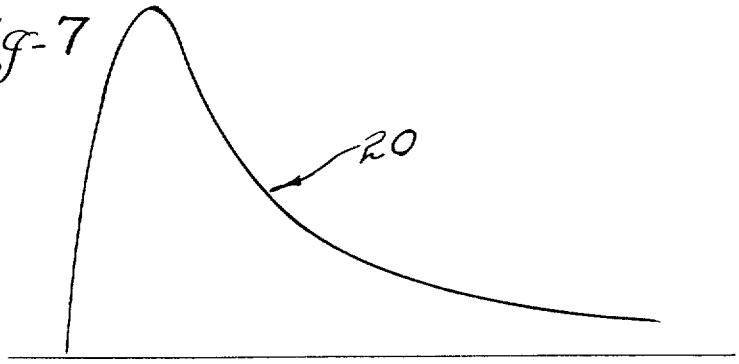
FIG. 7 is a piano voice characteristic envelope curve further illustrating the improvements thereof when utilized in connection with the present invention.

FIG. 7 illustrates a characteristic curve 20 which shows the composite characteristic piano voice keying envelope curve and, which closely approximates the sound produced by a real mechanical piano actuating mechanism.

The electronic musical instrument circuit 10 provides a new method of processing electronically produced audio signals of the piano voice characteristic type. For example, the method includes generating a fundamental square wave frequency of the piano tone to be audibly produced, developing at least one of the harmonic frequencies of the fundamental frequency, providing a gate signal corresponding to a characteristic piano voice having zero, attack, peak, and decay characteristic portions, limiting the amplitude of the harmonic signals to a predetermined minimum value, mixing the limited harmonic signal with that of the fundamental frequency only along predetermined selected portions of the piano voice characteristic curve, and controlling application of the fundamental frequency and the limited harmonic signals to an audio amplifier which ultimately produces the audio sound of the piano voice.

The circuit means 12 includes a capacitor 21 connected in parallel with a resistor 22 through a resistor 23 to form an RC timing network. The RC timing network receives charge from a B+ line, when the switch contacts of a piano by key structure 24 are closed. Therefore, in the normal condition capacitor 21 is charged to a maximum value of the B+ line. When the key 24 is actuated the associated switch contact thereof is disconnected from the B+ bus terminal and the capacitor 21 immediately begins to discharge through resistor 22 and resistor 23. As the key 24 is fully depressed the switch contact associated therewith engages a normally open terminal and the remaining charge on capacitor 21 is substantially instantly transferred to a capacitor 26 and parallel connected resistor 27 through a series connected diode 28. In this circuit configuration the amount of charge applied to capacitor 26 will substantially instantly form the attack characteristic portion 14 of the curve shown in FIG. 6 until the peak portion 15 is achieved at which time part of the charge on capacitor 21 has been transferred to the capacitor 26. The amount of charge deposited on capacitor 26 is that charge remaining on capacitor 21 after its initial discharge through its associated parallel connected resistor 22. Most advantageously, the rate of travel or the relative hardness with which the key is actuated will determine the amount of charge remaining on capacitor 21 which, in turn, will determine the amplitude of the peak characteristic portion 15 of the piano characteristic voice curve. Therefore, the harder the key is struck the louder the audio output.

When the key 24 returns to its normal position a transistor 29 has the base electrode thereof coupled back to the B+ line through a series connected resistor 30 and will therefore begin to conduct. Conduction of transistor 29 substantially instantaneously discharges capacitor 26 in readiness for a subsequent charge when the key structure 24 is actuated. Transistor 29 is biased to a forward conducting condition by a base resistor 31 and by suitably weighted load resistor 32 connected to the collector electrode thereof. The emitter electrode of transistor 29 is connected to ground potential through a selector switch 33 which may function as a damping or sustain switch and which may be actuated by a foot pedal as is customarily the case with pianos.

Conduction of transistor 29 causes damping of the characteristic curve as a result of discharging capacitor 26. When the switch 33 is in an open position transistor 29 is disabled and no damping of the characteristic curve is obtained. The decay characteristic portion of the piano voicing envelope curve will be gradual so that a sustained note will be obtained. As the volume of the sustained note diminishes, the quality of the note is sharpened to improve the piano sound of the curve for this period of time. Therefore, the diminished amplitude decaying portion of the piano voice characteristic curve only includes the fundamental frequency during the final decay portion 16.

The characteristic voicing curve developed by the circuit 12 is applied to a terminal point 34 and therefrom to the amplitude limiting circuit 17 so that selected portions of the characteristic curve can be delivered to gate circuits 36 and 37 which are connected to the output of the audio generating circuits. The amplitude limiting circuit 17 has the gate circuits thereof formed by a pair of field effect transistors 36 and 37 which function as series connected Zener limiting devices connected in series with associated ones of a pair of double gate field effect transistors 39 and 40, respectively. A third field effect device 41 is connected directly to the circuit point 34 over a line 42 and has no clipping action of the characteristic curve applied thereto. The gating device 41 passes the entire fundamental frequency including all portions from a zero amplitude to its peak amplitude. This is best illustrated by the portion of a characteristic curve 43 shown in connection with the output delivered across the line 42. Zener limiting device 37 allows passage of portions of the characteristic curve that exceed a predetermined minimum level, as indicated by the solid line of the curve 44. Similarly, Zener limiting device 36 allows passage of even less portions of the characteristic curve as indicated by the solid line and designated generally by reference numeral 46. By utilizing the limiting circuit arrangement 17 in conjunction with the gating circuits 39, 40 and 41 a unique combination of fundamental and harmonic frequencies is obtained along a piano voice characteristic envelope curve to substantially improve the sound quality of an electronic piano.

The fundamental frequencies developed within the electronic circuit 10 are obtained by initially providing an RF square wave generator 50 which has one output thereof connected to a multifrequency generator 51 and a second output thereof connected to a strobe circuit 52. The multifrequency generator 51 has a plurality of drive circuits which provide six frequencies which may be a half octave apart and delivered over a plurality of independent lines 53 to a series of divider circuits designated generally by reference numeral 54. A second plurality of output lines 56 extend from the multifrequency generator 51 and are arranged for connection to other divider circuits for operation with other keys on the keyboard. It will be understood that the single circuit arrangement shown with regard to the strobe 52 and dividers 54 are duplicated for as many times as there are keys on the keyboard.

FIG. 1 illustrates the circuit arrangement for one key to produce the proper piano voice characteristic curve. The divider circuit 54 generates the fundamental frequency to be delivered to the gate device 41 while the second harmonic frequency is delivered to the gate device 40 and the fourth harmonic frequency is delivered to the gate device 39. By combining just the right amounts of each of the components of the harmonic frequencies at just the right time along the characteristic curve, FIG. 6, both the correct frequency spectrum and the correct attack, and decay characteristics are obtained. The audio-frequencies provided by the divider 54, which are increasing and decreasing in amplitude according to the characteristic voicing curve, are mixed together and applied to an integrating circuit 60 through a series connected resistor 61. The integrating circuit 60 comprises a charging capacitor 62 and a parallel connected resistor 63 which is of a predetermined resistance value. The time constant of the circuit is sufficiently high to allow audio signal information to be developed thereacross yet sufficiently low to allow shunting of extraneous high frequency strobing signals to ground potential. The audio signal so developed across the network 60 is applied to any suitable filter and audio amplifier circuit 64 and therefrom to an audio reproducing device such as a loudspeaker 66.

Figure 11:
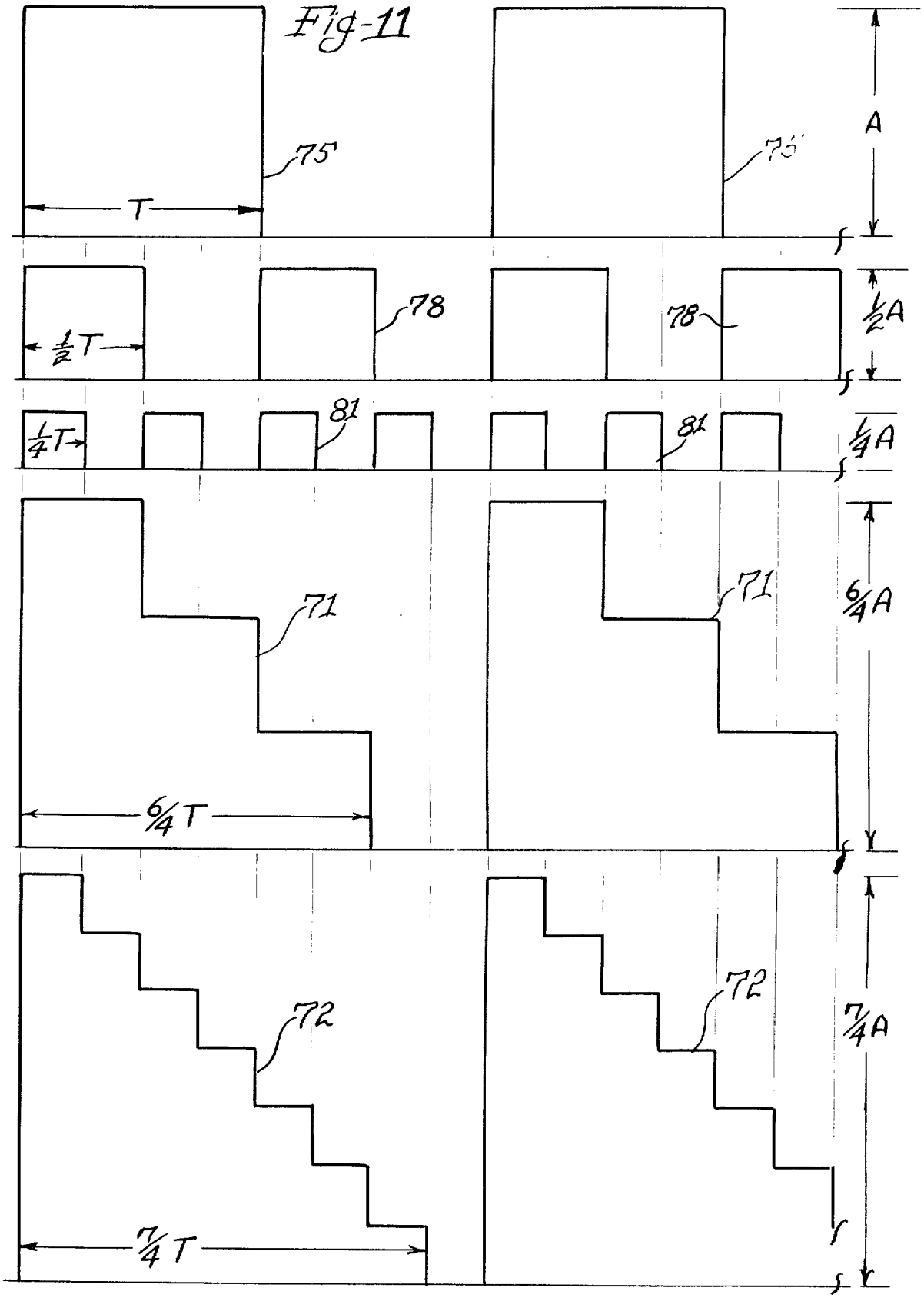
FIG. 11 illustrates the fundamental square wave and harmonic square wave signals and the addition during different parts of the characteristic curve.

Referring now to FIG. 11 there is seen a plurality of square wave signals which include the fundamental and second and fourth harmonics to be added together to form the various audio signal components along various parts of the piano voice characteristic curve. While uniform amplitude and time duration are shown for purpose of explanation it will be understood that the components to be added may have in fact different amplitudes and time proportions than those shown. Square wave 75 illustrates the fundamental square wave frequency and is here illustrated as being of a time interval per half cycle designated by reference letter T. The amplitude of the fundamental square wave frequency is designated by reference letter A. This varies with peak of the envelope curve. The second harmonic is illustrated by the series of square waves 78, and it will be noted particularly that the time interval of this second harmonic is one-half T and the amplitude is one-half A at one particular level of the envelope curve. Also the fourth harmonic indicated by the series square wave signals 81 is illustrated as having a time per square wave of one-fourth T and an amplitude of one-fourth A. When these signals are properly gated through the various switching devices 39, 40, and 41 for mixing and adding thereof, they will produce the necessary audio-signals. For example, during the initial time of the attack characteristic from between $t_0$ and $t_1$, of FIG. 6, only the fundamental frequency 75 will be applied to the network 60 at the input of the audio amplifier. However, during time interval $t_1$ through $t_2$ addition of the fundamental frequency 75 and the second harmonic 78 is accomplished and the sum signal frequency 71 is then applied to the network 60 at the input of the audio amplifier. Following this time interval the fourth harmonic 81 is now added to the second harmonic and the fundamental frequency so as to produce the stair-step signal configuration 72 during time interval $t_2 - t_3$.

Therefore, it will be understood that at a predetermined point along the voice characteristic curve of FIG. 6 an input amplitude of A of the fundamental frequency will produce a second harmonic amplitude of one half A and a fourth harmonic amplitude of one fourth A. At this same level the piano voice characters take a curve and input amplitude of one half A at the fundamental frequency will produce a second harmonic amplitude of zero and a fourth harmonic amplitude of zero. In like manner, an amplitude level of three-fourths A of the fundamental frequency will produce a second harmonic amplitude of one fourth A and a fourth harmonic amplitude of zero. It will be noted that the ratio between the fundamental frequency amplitude and the second harmonic amplitude is three to one rather than two to one when the amplitude level of the fundamental frequency is A as described above. This then will produce varying ratios of amplitude between the different steps of the stair-step wave shape of FIG. 3. With an amplitude level of five-fourths A of the fundamental frequency a second harmonic amplitude of three-fourths A is obtained while a fourth harmonic amplitude of two-fourths A is obtained. This then will provide a five to three ratio between the fundamental and second harmonic amplitude and a five to two ratio between the fundamental and the fourth harmonic amplitude.

Of particular interest is the increase in amplitude of the audio signal as a result of adding the fundamental and harmonic frequencies at the particular time intervals. Therefore, not only does the piano circuitry of this invention provide attack, peak, and decay characteristics using controlled charge and discharge of a capacitor, it also provides additional impetus to the characteristic curve by automatically increasing the amplitude of the audio signal in response to the addition of harmonics. It will be noted that the addition of the fundamental square wave 75 and the square wave harmonics 78 and 81 result in a descending stairstep wave shape, which may be filtered, to produce each audio cycle of the tone being generated.

Figure 2:
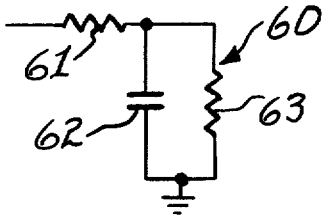
FIG. 2 illustrates a circuit arrangement for eliminating R.F. multiple frequencies and receiving the mixed audio signals, containing fundamental frequencies and harmonic frequencies, to produce integrated audio signals.
Figure 3:
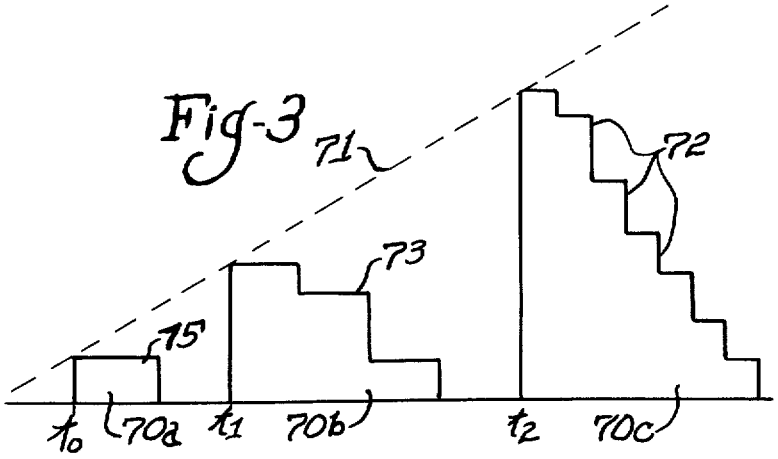
FIG. 3 is a graphical representation illustrating the signals that are developed across the network of FIG. 2 during the attack portion of the envelope characteristic curve.

For a better understanding of the filtering operation of the integrating circuit 60 reference is now made to FIGS. 2 and 3 which illustrate the nature of the audio signal components applied thereto for integration. FIG. 3 illustrates the series of audio frequency signals 70*a*, 70*b*, and 70*c* contained within the attack portion of the envelope which is indicated by the broken lines 71. The envelope 71 is shown having a substantially gradual slope for purposes of clarity, but it will be understood that the portion of the wave shape shown may correspond to the attack portion 14 of the curve shown in FIG. 6. When the reverse sequence of the audio signals is reversed, e.g. 70*c*, 70*b*, 70*a*, it will represent the decay portion 16 of the curve. Each audio cycle 71 and 72 within the characteristic curve is composed of a series of stairstep pulses which are combined together as a result of the gating devices 39, 40, and 41 and which are ultimately filtered in the integrating circuit 60. The combining of the harmonics is accomplished by synchronizing operation of the gating circuits 39, 40, and 41 by turning on a strobe signal from the strobe circuit 52 at selected intervals along with signals from the divider circuit 54. While only a single wave shape of each of the pulses 71, 72, and 75 is shown, it will be understood that there may be a plurality of such pulses being generated during the advance of the attack portion of the characteristic curve. In the illustrated embodiment the output from each of the strobe lines can be one-third the frequency of the input so that substantially equal weighting of the signals can be obtained. It will be understood however, that other output intervals may be utilized, for example, one output line may have two, three, or more time interval pulses related thereto with respect to other outputs from the strobe.

Figure 8:
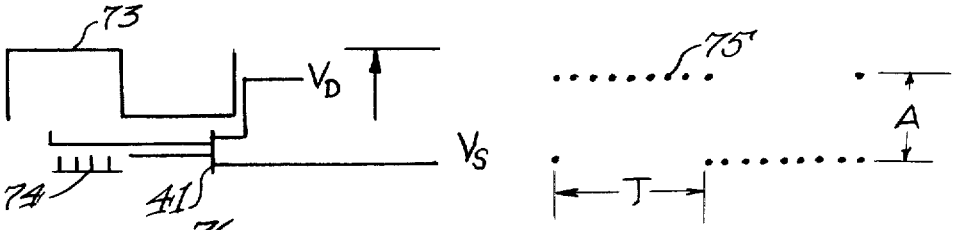
FIGS. 8, 9 and 10 illustrate various aspects of the gating circuit and have shown at the right side thereof the output pulse signals which are used to generate piano tones in accordance with the principles of this invention.
Figure 9:
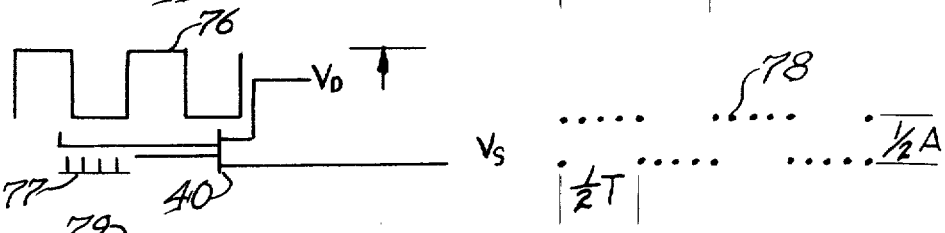
Figure 10:
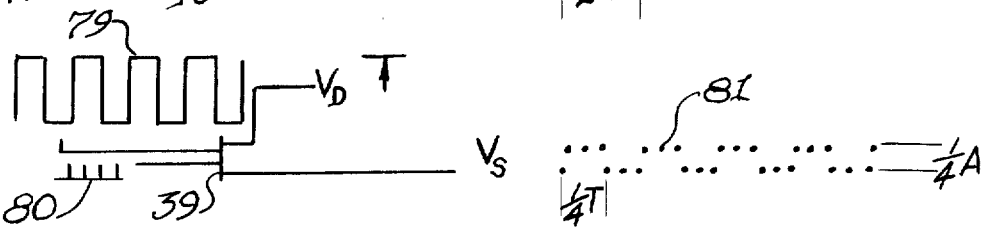

For a better understanding of the divider and strobe signals applied to the gating elements 39, 40, and 41 reference is now made to FIGS. 8, 9, and 10 which duplicate only the gate circuit portions and have illustrated input signal wave forms applied to their control electrodes. For example, the fundamental frequency applied to one of the control electrodes of the gate element 41 is illustrated by reference numeral 73 while a plurality of strobe signals 74 are applied to the other control electrode of the gating device. The ultimate output wave form is a combination of strobe and divider signals, respectively, and has substantially the form of a series of pulses indicated by the dotted wave form 75. The gate component 40, on the other hand, has the first harmonic signal 76 applied to one of its control electrodes while a strobe signal 77 is applied to the other control electrode. The combination of a second harmonic and the strobe signals will produce a series of pulses corresponding substantially to the dotted wave form 78. In like manner, the fourth harmonic 79 is applied to one control electrode of the gate device 39 while strobe signals 80 are applied to the other control electrode. This will produce a dotted waveform 81. All the signals ultimately are combined or added together at the output line 82, FIG. 1, and produce each of the audio-signals 70*a*, 70*b*, and 70*c*, as illustrated in FIG. 3. Summing of each of the signals will produce the stair-step configuration 72 of FIG. 3, each of the audio signals.

Figure 4:
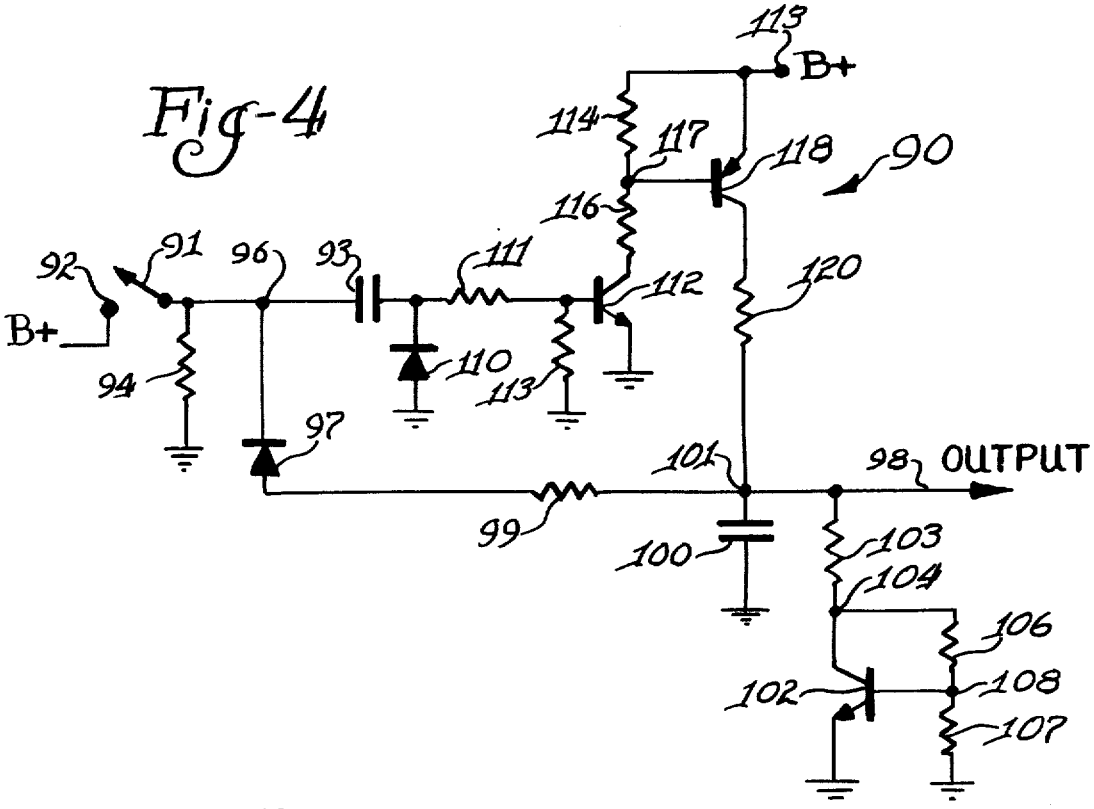
FIG. 4 is a schematic diagram of a circuit which is utilized to rapidly extinguish the decay characteristic portion of the curve when the piano key is released so that rapid successive actuations of the piano key can be obtained.

Referring now to the FIG. 4 there is seen another novel circuit arrangement which can be used to obtain the desired attack, peak and decay piano voice characteristic curve required for utilization of the signals obtained from FIG. 1, and is designated generally by reference numeral 90 FIG. 4 can replace the circuit shown in FIG. 1. Here the circuit 90 has a piano acutated key member 91 selectively connected to a B+ terminal point 92 on actuation of the key. The key switch 91 is connected to a charging capacitor 93 and to a fixed resistance element 94. The circuit point 96 has the cathode electrode of a diode 97 connected thereto while the anode electrode of the diode 97 is connected to an output line 98 through a series connected fixed resistance element 99. A second charging and discharging capacitor 100 is also connected to the output line 98 by means of a terminal point 101. The DC level of the voltage applied to the output line 98 is sensed at the collector electrode of a transistor 102 which, in turn, is connected to a series connected load resistor 103 by means of a terminal point 104. This circuit will function as a zener clamping circuit so that the DC resistance path from the output line 98 will change in response to changes in the DC level of the voice characteristic curve applied thereto. A voltage divider network comprising a pair of series connected resistors 106 and 107 have the intermediate terminal point 108 thereof connected to the base electrode of a transistor 102 for placing operating bias on the transistor.

Capacitor 93 has the output end thereof connected to a diode 110 which functions as a discharge path for the capacitor when the voltage crossing capacitor is reversed. The circuit point connecting capacitor 93 with diode 110 is also connected to a series resistor 111, which, in turn, is connected to the base electrode of the transistor 112. The base electrode of transistor 112 also has a fixed value to resistor 113 connected thereto. Transistor 112 is rendered conductive as the result of operating voltage applied thereto from a terminal point 113 through a pair of series connected resistors 114 and 116. The circuit point 117 located between the resistors 114 and 116 is connected to the base electrode of the transistor 118. Transistor 118 has the emitter collector current path therethrough connected between the voltage source terminal 113 to terminal point 101 through a fixed value to series resistor 120. The resistance value of the resistor 120 may be in the order of about 100 ohms in the illustrated circuit.

In operation, the piano key switch 91 is closed and connected to the B+ source applied to terminal point 92. This action will cause a positive voltage instantly to be sensed on both sides of the charging capacitor 93 thereby rendering transistors 112 and 118 instantly conductive. This is accomplished as a result of operating bias current being applied to transistor 112 through resistor 111 to render the transistor conductive. Transistor 112 in turn causes bias current to pass through the emitter base junction of a transistor 118 to render it conductive.

Figure 5:
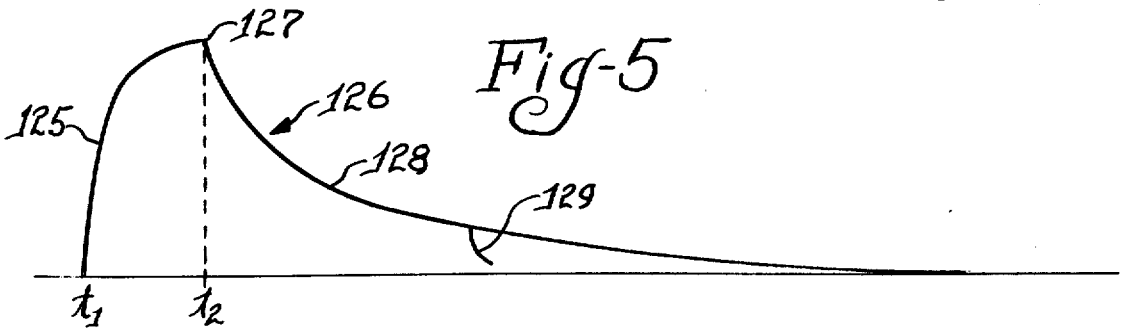
FIG. 5 illustrates the output characteristic curve which is obtained from the circuit arrangement of FIG. 4.

Each time the transistor 118 is rendered conductive the voltage cross capacitor 100 rises in accordance with the time constant established by the relatively low value of resistor 120 and the capacitance value of the capacitor 100. This will result in a relatively rapid attack portion of the piano characteristic curve as best seen in FIG. 5. FIG. 5 shows the left hand leading edge 125 of a piano voice characteristic curve 126 as being substantially expodential is a characteristic yet being relatively rapid in rate as compared to the discharge or decay characteristic of the piano voice curve. The peak portion 127 of the curve 126 is obtained when capacitor 100 is at its fully charged state.

As mentioned above resistor 120 and capacitor 100 provide the RC time constant for the charge rate of the capacitor. However, the duration of time of the attack portion 125 of the curve 126 is determined by the time constant of capacitor 93 and series connected resistor 111. This time duration is indicated between the time intervals $t_1$ and $t_2$ of FIG. 5.

When capacitor 93 charges sufficient so that the voltage at the cathode electrode of diode 110 decreases and is not enough to hold transistors 112 and 118 in their conductive state the transistors turn off and the voltage at terminal point 101 begins to decrease in accordance with the decay characteristic portion 128 of the curve 126. This decay characteristic curve will continue exponentially as long as the piano key switch 91 is in the closed position.

As a result of the bias turn-on voltage of the transistor 102 it functions substantially as a soft zener diode circuit. Therefore resistor 103 will provide one resistance value to terminal point 101 when transistor 102 is conductive and the total resistance values 103, 106 and 107 to terminal point 101 when transistor 102 is non-conductive. The ratio of the resistance values of resistors 106 and 107 multiplies the base voltage of transistor 102 to obtain a multiple of the base voltage at the collector electrode thereof to obtain the desired zener effect. Therefore selecting the proper resistance values will change the zener voltage.

When the voltage at terminal point 101 is greater than the selected zener voltage at terminal point 104 transistor 102 is rendered conductive and the decay slope portion of the characteristic curve obtained at output line 98 is determined by the time constant established by capacitor 100 and resistor 103. As the voltage at terminal point 101 decreases and approaches the voltage value obtained at the terminall point 104 transistor 102 will become less conductive ultimately to be rendered non-conductive and the decay curve obtained at the output line 98 will change as a result of the time constant established by capacitor 100 and resistors 103, 106 and 107. It will be noted that the resistance value of resistor 106 is selected to be relatively large as compared to the resistance value of resistors 103 and 107. This then provides a substantial difference in the resistance value applied to terminal point 101 depending on whether or not the transistor 102 is conductive and provides means for applying operating bias voltage of the desired amount to the base electrode of transistor 102.

If during the decay characteristic portion 128 of the curve 126, FIG. 5, the key switch 91 is released and the decay is substantially shortened by the addition of a secondary decay path through resistor 99 and diode 97 to ground potential through a resistor 94. This rapid decay characteristic is illustrated by the curved portion 129 of the piano characteristic curve 126 of FIG. 5. Furthermore it will be noted that this rapid decay on release of key switch 91 allows for a rapid open and closure operation of the key switch which is necessary or certain kinds of piano playing.

What has been described are simple and unique circuit arrangements for obtaining the necessary piano voice frequencies and piano voice characteristic curve to enable an electronic musical instrument to sound substantially the same as an actual piano. Accordingly, many variations and modifications of the disclosed invention may be made without parting from the spirit and scope of the novel concepts set forth in the following claims.

The invention is claimed as follows:

1. An electronic musical instrument of the keyboard type comprising: electronic means for audibly producing a square wave fundamental frequency and at least one square wave harmonic frequency thereof in response to the actuation of a key on a keyboard, said electronic means including gate circuit means for providing amplitude control of said square wave fundamental and harmonic frequencies, and means responsive to said amplitude control of said electronic means for adding together said fundamental and harmonic frequencies at predetermined points in time along the zero, attack, peak, and decay of a characteristic piano voice curve.

2. The electronic musical instrument according to claim 1, wherein adding of said harmonic with said fundamental frequency occurs at a predetermined amplitude of said piano voice characteristic curve, said adding being initiated at a time after initial actuation of the piano key and being maintained for a predetermined time interval and terminating at a time prior to the complete decay of said piano voice curve.

3. The electronic musical instrument according to claim 1, wherein said electronic means produces two harmonic frequencies and wherein said gate circuit means provides amplitude control of said two harmonic frequencies at different amplitude levels of said characteristic piano voice curve.

4. The electronic musical instruments according to claim 3, wherein said two harmonics are the second and fourth harmonics of said fundamental frequency, and when said fundamental frequency has an amplitude of A, said second harmonics will have an amplitude in the order of about one half A, and said fourth harmonic will have an amplitude in the order of about one fourth A.

5. The electronic musical instruments according to claim 4, wherein electronic means including gate control means for adding together said square wave fundamental and said second harmonic frequencies in time sequence during a discrete attack portion and during a discrete decay portion of the piano voice curve and for adding together said fundamental and said second and fourth harmonic frequencies in time sequence during a discrete peak portion of said piano voice curve.

6. The electronic musical instrument according to claim 5, wherein the addition of said second and fourth harmonics with said fundamental frequency will produce a descending stair-step wave shape.

7. A method of processing electronically produced piano tone signals comprising the steps of generating a square wave fundamental frequency of the piano tone to be audibly produced, developing at least one square wave harmonic of said fundamental frequency, providing a gate signal having a zero, attack, peak, and decay characteristic of a piano voice curve, limiting the amplitude of said harmonic to a predetemined minimum value, adding said limited harmonic with said fundamental frequency at a selected point along the piano voice curve to produce a composite signal and controlling application of said composite signal to an audio-amplifier.

8. The method according to claim 7 wherein the adding of said square wave fundamental frequency and said square wave harmonic frequency occurs in time sequence to form a descending stair-step wave shape of said composite signal.

9. In an electronic musical instrument of the keyboard type the combination including: circuit means for producing a gate signal in response to the actuation of an associated key of a keyboard, said gate signal having a wave shape determined by said circuit means and which wave shape corresponds to the zero, attack, peak, and decay characteristic of a piano voice curve, audio signal generator means for producing fundamental square wave frequency and at least one square wave harmonic of said fundamental square wave frequency, audio amplifier means for receiving said fundamental and said second harmonic signal, gate circuit means coupled between said audio signal generator means and said audio amplifier means and responsive to said gate signal when a key is depressed to allow said fundamental square wave frequency and said at least one square wave harmonic to pass from said audio-signal generator means to said audio-amplifier means, and means coupled to said gate circuit means to provide amplitude control of said square wave harmonic when added with said fundamental square wave frequency, said amplitude control taking effect at predetermined points along said piano voice characteristic curve.

10. The electronic musical instrument according to claim 9, wherein said means coupled to said gate circuit means controls the amplitude at which said square wave harmonic is added to said fundamental square wave frequency.

11. The electronic musical instrument according to claim 9, wherein said means coupled to said gate circuit means includes voltage regulator means having first and second predetermined minimum voltage values which must be exceeded to allow passage therethrough of said gate signal, said first limiting means being connected to circuit means controlling a first square wave harmonic of said fundamental square wave frequency and said second limiting means being connected to means for controlling a second square wave harmonic of said fundamental frequency, whereby adding of said fundamental square wave frequency and said square wave harmonics occurs at voltage values above a predetermined minimum value.

12. The electronic musical instrument according to claim 11, wherein said first and second limiting means allows passage of said first and second harmonics at different voltage values.

13. The electronic musical instrument according to claim 11 wherein said first square wave harmonic is the second harmonic of said fundamental frequency and said second square wave harmonic is the fourth harmonic of said fundamental frequency.

14. In an electronic musical instrument of the keyboard type the combination including: a piano key switch having first and second spaced apart switch terminals, said first switch terminal being connected to a voltage source and in contact with a movable contractor of the piano key switch when in an unactuated position, a first charging circuit means connected to said movable contactor for receiving a charge from said voltage source, a second charging circuit coupled to said second switch terminal for receiving charge from said first charging circuit when said piano key switch moves from said first terminal to said second terminal, gate circuit means coupled to said second charging circuit for providing gate signals in response to the amplitude of the voltage applied thereto from said second charging circuit connected to said first charging circuit means for discharging the same at a predetermined rate when said movable contactor is disengaged from said first switch terminals, said first charging circuit means transferring its charge to said second charging circuit means when said movable contactor engages said second switch terminal, and the amplitude of charge applied to said second charging circuit means will correspond to the amplitude of charge then remaining on said first charging circuit means at the moment of contact between said movable contactor and said second switch terminal to produce an audio output signal having an amplitude corresponding to the speed at which said movable contactor is actuated.

15. In the electronic musical instrument as set forth in claim 14, wherein said first and second charging circuits each comprise parallel connected resistor and capacitor elements, said second charging circuit further including a series connected diode between said capacitor and resistance elements and said second switch terminal.

16. In the electronic musical instrument as set forth in claim 14, further including field effect transistors operative at different amplitude levels and operatively connected to said gate circuit means for controlling different harmonic frequencies of the fundamental frequency then being produced in response to the output amplitude of said second charging circuit means.

17. In the electronic musical instrument as set forth in claim 14, wherein said second charging circuit means receives the voltage from said movable contactor through transistor means and charges at a rate corresponding to the attack characteristic portion of a piano voice characteristic curve, said second charging circuit means discharging through a first resistance path of a first resistance value during a first time interval of the decay portion of said piano voice characteristic curve and through a second resistance path which has a resistance value greater than said first resistance during an immediate subsequent time interval of the decay portion of the piano voice characteristic curve.

18. In the electronic musical instrument according to claim 17, further including a third discharge circuit means connected to said second capacitor, said third discharge path being responsive to the opening of said movable contactor and said second terminal to completely discharge said second capacitor.

* * * * *